United States Patent [19]

Rhodes, Jr. et al.

[11] 4,436,403

[45] Mar. 13, 1984

[54] GUIDANCE CORRECTION METHOD AND APPARATUS FOR COPY PAPER PATH IN A COPIER

[75] Inventors: John H. Rhodes, Jr.; Alfonso A. Rosati, both of Longmont, Colo.

[73] Assignee: International Business Machines Corporation, Armonk, N.Y.

[21] Appl. No.: 385,592

[22] Filed: Jun. 7, 1982

[51] Int. Cl.[3] ..... G03G 15/00

[52] U.S. Cl. ..... 355/3 SH; 271/226; 271/DIG. 2; 271/184; 355/3 TR; 355/77

[58] Field of Search ..... 355/3 SH, 3 TR, 3 R, 355/14 SH, 77; 271/226, DIG. 2, 184, 507, 311–313

[56] References Cited

U.S. PATENT DOCUMENTS

| | | | |
|---|---|---|---|
| 3,984,183 | 10/1976 | Maksymiak | 355/16 |
| 3,994,487 | 11/1976 | Wicklund | 271/80 |
| 4,091,978 | 5/1978 | Graham | 225/100 |
| 4,179,116 | 12/1979 | Umezawa et al. | 271/306 |
| 4,188,025 | 2/1980 | Gusfafson et al. | 271/314 |
| 4,232,323 | 11/1980 | Kokaji et al. | 346/74.1 |
| 4,234,305 | 11/1980 | Miyake et al. | 432/59 |
| 4,244,648 | 1/1981 | Schultes et al. | 355/14 |
| 4,319,829 | 3/1982 | Janeway et al. | 355/3 |

OTHER PUBLICATIONS

Xerox Disclosure Journal, "Skewed Blade Stripper" by J. J. Knieser, vol. 2, No. 6, Nov./Dec. 1977, pp. 85–86.

IBM Technical Disclosure Bulletin, "Fuser Entry Guide and Copier Bubble Former" by D. C. Estabrooks and C. W. Knappenberger, vol. 23, No. 1, Jun. 1980, p. 71.

*Primary Examiner*—R. L. Moses

*Attorney, Agent, or Firm*—Earl C. Hancock

[57] ABSTRACT

A bender bar intercepts xerographic copier paper traveling from a transfer corona to the fuser rolls in a manner that compensates for sheet skew before the sheet arrives at the nip of the transfer rollers. The bender bar is fixed in position but adjustable so that copy sheets encountering the bar can have different path lengths with respect to opposite ends of the bar as encountered by the sheets. The sheet leading edges arrive at the fuser roll nip in a manner that compensates for any transfer distortion caused by factors such as axial misalignment between the fuser and input rolls, engagement of the paper by other elements associated with the transfer station paper path, or the like.

7 Claims, 4 Drawing Figures

GUIDANCE CORRECTION METHOD AND APPARATUS FOR COPY PAPER PATH IN A COPIER

CROSS-REFERENCE TO RELATED APPLICATION

Application Ser. No. 06/173,590 filed July 30, 1980 for "Noncircular Photoconductor Belt Mounting Apparatus and Method" by D. L. Janeway and P. A. Stevenson, now U.S. Pat. No. 4,319,829, which is assigned to the same assignee as this application, shows one compact copier environment in which the present invention is particularly useful.

BACKGROUND OF THE INVENTION

1. Field of the Invention

The present invention relates to methods and apparatus for handling copy sheets in xerographic copiers and the like. More particularly, the present invention relates to methods and apparatus for handling copy sheets through image transferring stations in xerographic copiers or the like. The present invention is especially useful for copier configurations wherein copy paper is curved as it is driven through a latent image transfer station to an output driving means.

2. Description of the Prior Art

Development of compact, low-cost xerographic copiers suitable for use as table-top machines demands substantial efforts toward minimization of the machine volume. Furthermore, design and use of such compact copiers is simplified if the transfer sheet paper path is arranged such that one end or the other of each copy sheet is physically available for extraction from the machine in the event of a jam thereby reducing the necessity for special mechanisms and user procedures to allow internal access to the machine. Such a paper path preferably follows a U-shaped arrangement to avoid interference with other elements associated with the copier. This is particularly true in configurations wherein semiautomatic document feeds or recirculating automatic document feeds are employed.

One example of a highly compact xerographic copier is shown in copending application Ser. No. 173,590 filed July 30, 1980 and entitled "Noncircular Photoconductor Belt Mounting Apparatus and Method" by D. L. Janeway and P. A. Stevenson which is commonly assigned and now issued as U.S. Pat. No. 4,319,829. In this cross-referenced structure, the copy sheets are produced or extracted from a cassette and urged by thrust rollers into a U-shaped paper path including a corona transfer station and thence through fuser rollers before exit to an output pocket on the top of the supply cassette. So long as the rollers associated with the input and the output paths relative to the transfer station are maintained in relatively close parallel alignment, image transfer is generally satisfactory. However, wear of the roller surfaces or any slight misalignment causes copy sheet rotation and skewing so that image blurring occurs when the copy sheet is gripped by the output rollers at the same time that it is propelled by the input rollers. This blurring results from skew of the paper as it passes through the image station and enters the nip of the output rollers. That is, failure of the copy sheet to enter the output roller nip in a true or square relation results in application of skewed forces to the paper which is transferred to the paper at the image transfer station such that the image sometimes tends to blur.

The prior art devices do not resolve the aforementioned copy sheet skewing problem. For instance, the IBM *Technical Disclosure Bulletin* of June 1980 (Vol. 23, No. 1) at page 71 in the article entitled "Fuser Entry Guide and Paper Bubble Former" by D. C. Estabrooks and C. W. Knappenberger shows a pivotable guide to help accommodate the bubble formed in the copy sheet as it leaves the detack finger downstream from the image transfer station. This bubble is intended to act as a buffer between the differing speeds of the transfer drum and hot roll fuser rollers. It does not properly align the copy sheet leading edge as it enters the fuser nip.

It is also known to employ sloped transition surfaces between pairs of drive rollers for bursting continuous forms wherein the sloped surface and rollers are positioned such that the output rollers squarely receive the copy sheets. This is shown as the curved guide member between first and second feeding roller pairs in the sheet handling apparatus of U.S. Pat. Nos. 3,994,487 by H. P. Wicklund and 4,091,978 by J. E. Graham. Both the Wicklund and Graham devices employ the sloped guide member for the purpose of creating edge stress on continuous web output sheets so that severence of perforations transverse to the sheet commences at the stressed edge and tear or "burst" progressively across the sheet.

Despite the presence of the foregoing prior art, no solution to the copy sheet skewing and image transfer blurring problem associated with passing xerographic copy sheets through transfer stations has evolved as is now available through the present invention.

DISCLOSURE OF THE INVENTION

The present invention is particularly useful in copiers having a first means for driving copy sheets through an image transfer station and thence into a second driving means such as fuser rollers and the like of the copier. The second driving means withdraws the copy sheet from the transfer station and the copy sheet follows a generally curved path between the transfer station and this second driving means.

The improvement in accordance with this invention includes use of a bender bar having at least a portion of the surface thereof formed as an elongated edge. A mounting means for this bender bar locates this edge so as to form an inner guide for the copy sheets passing through the aforementioned curved path. The mounting means includes means establishing different path lengths as between opposite ends of this bender bar for copy sheets traveling from the image transfer station to the second driving means. Accordingly, the path length establishing means compensates for twisting motions to copy sheets by the first and second driving means and prevents distortion in image transfer to the copy sheets.

The path length establishing means preferably includes an arrangement selectively adjusting the position of the bender bar for compensating for differing copy sheet twisting motions through the curved path. The elongated edge of the bender bar may include a curved surface extending generally transverse to the direction of copy sheet movement through the curve path and further, the adjusting means can allow selective positioning of one end of the bender bar in the aforementioned transverse direction.

The bender bar can have at least a portion of its surface formed as an elongated curved surface mounted in generally facing relation to the curved guide for the paper path between the transfer station and the second driving rollers.

Those having normal skill in the art will readily recognize the foregoing and other objects, features, advantages and applications of the present invention in the light of the following more detailed description of the exemplary preferred embodiment as illustrated in the accompanying drawings.

DETAILED DESCRIPTION OF THE PREFERRED EMBODIMENT

Figure 1:
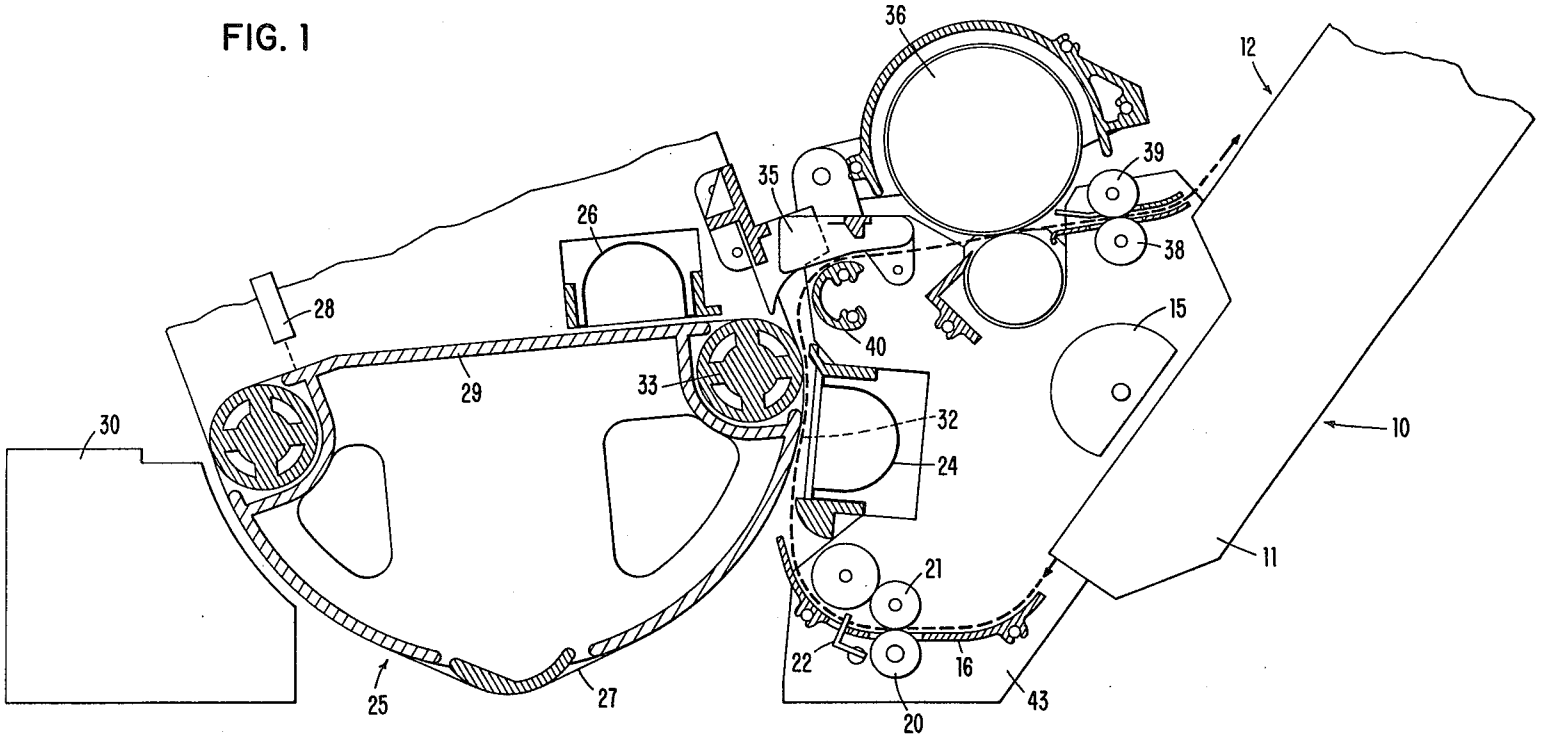
FIG. 1 is a somewhat schematic side view of a typical compact copier including a copy sheet paper path adjustment in accordance with the present invention.

FIG. 1 is a somewhat schematic, plan view of elements associated with a compact xerographic copier configuration. Many of these elements are substantially the same and operate in the same manner as those shown and described in commonly assigned and copending application Ser. No. 173,590 filed July 30, 1980, now U.S. Pat. No. 4,319,829. Cassette 10 includes a lower copy sheet supply bay 11 and an upper exit pocket 12 for receiving documents exiting from the copier. Picker rollers 15 are activated as by a solenoid or the like for engaging the topmost sheet of the stack within bay 11 so as to drive that sheet by corner buckling into the paper guide 16. The upper surface of bay 11 under rollers 15 is open to allow rollers 15 and the top sheet of the stack to engage one another.

Guide 16 directs the paper into the nip of thrust rollers 20 and 21 which register the leading edge against pivotable gate 22. Appropriate mechanisms such as a cam or the like activates gate 22 subsequent to proper leading edge registration to release the paper sheet so as to pass under transfer corona 24 in synchronization with the photoconductor latent image. The photoconductor is contained in assembly 25 as a belt 27 rotatably mounted around triangular-shaped frame or capstan 29 (note FIG. 2). As is conventional in the xerographic art, belt 27 is initially charged by corona 26, imaged from the original document or the like by optics 28, shown here by way of example as a fiber optic bundle. The image is developed at developer 30 for subsequent transfer to the copy sheet as the photoconductor belt and copy sheet pass through the transfer station under transfer corona 24.

As the copy sheet continues past transfer station 24 along the path generally indicated by dashed line 32 and the photoconductor belt bends away from path 32, the copy sheet initially detaches from the photoconductor belt because of the sheet beam strength. The sheet is intercepted by deflector fingers 35 to direct the sheet into a generally curved path towards the fuser comprised of a hot roll 36 and a backup roll 37. The copy sheet is ejected into exit tray 12 by exit rollers 38 and 39. Typically, the fuser station is composed of a hot roll 36 covered with a soft material such as silicon rubber or the like and a hard-surfaced backup roll 37. Bender bar 40 is positioned to assist in directing the copy sheet from the transfer station at corona 24 into the nip formed between rollers 36 and 37.

Copy sheets unfortunately tend to rotate or skew during transfer when the paper is fed between rollers 20/21 and 36/37. This is caused by several factors. First, a difference in feeding velocity at each of the roller pairs exists because of variations in diameter, normal force differences and deformation of rubber materials on some of the rollers. Secondly, misalignment of the thrust roller axis with respect to the photoconductor rotating axis further enhances the paper skew. Additionally, misalignment of the fuser axis with respect to the photoconductor and/or thrust roller pair 20/21 axis contributes to the paper skew problem. Still further, the leading edge misalignment at the nip between rollers 36 and 37 is potentially aggravated by the location of bender bar 40.

Figure 2:
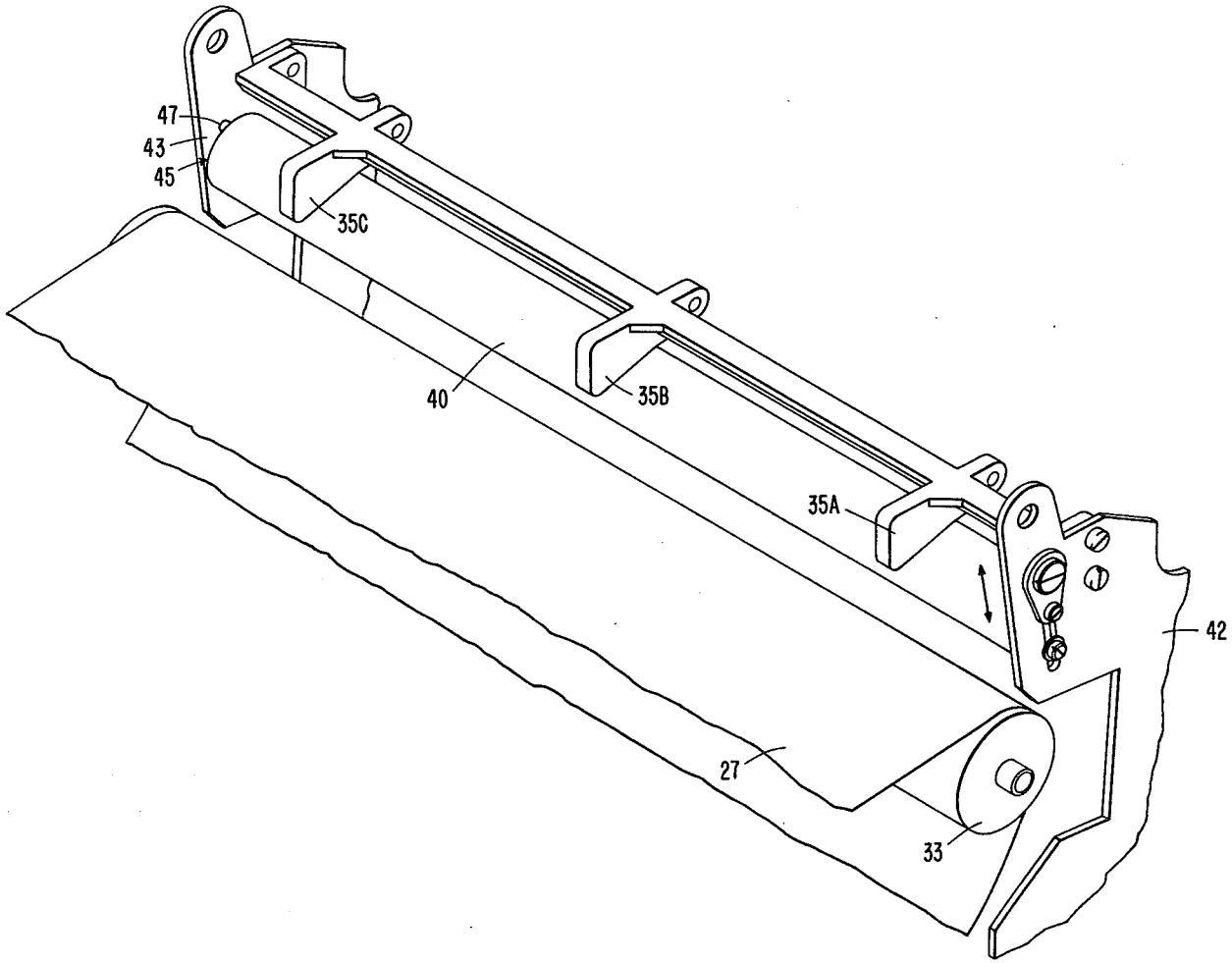
FIG. 2 is a somewhat simplified, partially broken isometric view of some of the components of FIG. 1.
Figure 3:
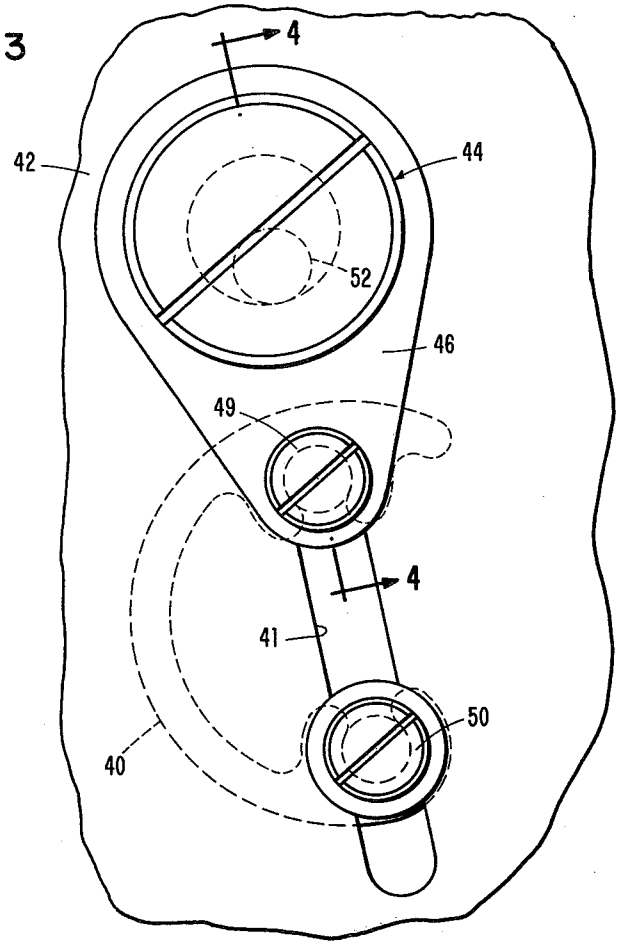
FIG. 3 is an expanded, plan view of the bender bar positioning apparatus of FIG. 2.

Removal or at least reduction of the image transfer degradation resulting from rotation of the copy sheet during transfer because of factors such as those mentioned above is realized by the present invention. More particularly, bender bar 40 is positioned in accordance with this invention so that the path of the copy sheet as it travels around bar 40 has a longer path length at one end, thereby realigning the copy sheet leading edge as it enters the fuser roll nip. Although permanent mounting of bar 40 in such a position is possible, it is preferable to include an adjustable movement of one end of bender bar 40 along slot 41 as shown in FIGS. 2 and 3. That is, by use of the positioning structure associated with eccentric assembly 44 and by retaining the opposite end as by pivot pin 47 shown generally at 45 in relatively fixed position, the axis of bender bar 40 is movable relative to the direction of the paper path movement (i.e. transverse to the tangent of copy sheet engagement with bar 40) and in a manner that skews the bender bar 40. By adjusting bender bar 40, the copy sheet leading edge is forced to follow a different path at one edge, therefore changing the angle at which the paper enters the nip between rollers 36 and 37 at the fuser station. The rotation created by adjusting leading edge entrance reduces or removes image transfer blurring by counterbalancing the rotation created by the factors mentioned above and by the input feed rollers 20/21 or the like. The final result is a paper path that has little rotation at the transfer station 24 and removal of blurring caused by movement of the paper as it passes through transfer station 24. Inclusion of a skew angle adjustment for bender bar 40 allows correction for copy sheet misalignment as the parts wear and also somewhat relaxes assembly tolerances for the machine.

Figure 4:
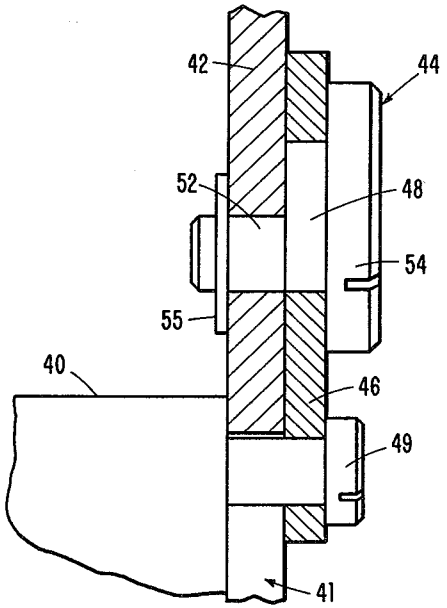
FIG. 4 is a broken, partially sectioned view of the FIG. 3 positioning screw structure.

FIGS. 3 and 4 illustrate detail of the structure for shifting bender bar 40 along slot 41. Link 46 is engaged in freely rotating relation to center hub 48 of assembly 44 and also receives in free rotational relation pin 49 which passes through slot 41. Pin 49 is attached to bar 40 as is pin 50, both sliding within slot 41. Assembly 44 is attached to frame 42 by stub 52 which is eccentrically located relative to the slotted head 54. A C-ring 55 holds assembly 44 in place. As head 54 is pivoted by a suitable tool, coupling or the like, hub 48 drives link 46 so that pins 49 and 50 slide within slot 41 thereby controlling the angle of copy sheet engagement by the surface of bar 40.

Frame elements 42 and 43 shown in FIG. 2 are fixed relative to the main machine frame. FIG. 2 further shows somewhat more graphically the relationship established for photoconductor belt 27 by belt mounting frame 29 of the photoconductor assembly 25 described in FIG. 1. Note that the deflector fingers 35*a*–35*c* are held in fixed relation to the frame members 42 and 43 as are the mounting shafts for input rollers 20 and 21. Photoconductor belt 27 is driven by drive roller 33 by means not shown. The corona for transfer station 24 is omitted from FIG. 2.

Reviewing, copy sheets following a curved paper path from input rollers through a transfer station to output rollers as in compact copiers employing a U-shaped copy sheet paper path tend to engage the output rollers (usually the fuser roller nip) with a skewed leading edge. The U-shaped paper path configuration for compact copiers is attractive because it facilitates jam recovery by allowing user access to either the leading edge or the trailing edge of the copy sheet without requiring special copier opening mechanisms. Skewed copy sheets passing through the transfer station are pulled unevenly through that station and copy transfer blurring results. This condition is particularly evident where the copy sheet is positively gripped on both ends as it passes through a corona-type image transfer station. The present invention resolves that problem by ensuring aligned leading edge engagement into the exit drive (e.g. into the nip between fuser rollers 36 and 37).

Although the foregoing describes the exemplary preferred embodiment in relatively specific detail, those having normal skill in the art will recognize various changes, modifications, additions and applications other than those specifically mentioned herein without departing from the spirit of this invention. For instance, although the preferred embodiment is described with respect to a photoconductor belt rotating around a generally triangular-shaped mount, the invention is equally useful for drum type photoconductors or the like. The invention is especially advantageous for use at any time that skewed copy sheets are potentially twisted as they pass through the transfer station in response to drive applied to the sheets on either side of the transfer station or even simply between a transfer roller at the transfer station and exit and/or input rollers, vacuum transports and the like.

What is claimed is:

1. In a copier having first means for driving copy sheets through an image transfer station and thence into second driving means such as fuser rollers and the like for withdrawing the copy sheets from the transfer station and wherein the copy sheet follows a curved path between said transfer station and said second driving means, an improvement comprising:

a bender bar having at least a portion of the surface thereof formed as an elongated edge; and means mounting said bender bar with said edge forming an inner guide for copy sheets passing through said curved path, said mounting means including means establishing different path lengths as between opposite ends of said bar for copy sheets traveling from said image transfer station to said second driving means, whereby said path length establishing means compensates for twisting motions to copy sheets which cause distortion and blurring in image transfer to the copy sheets.

2. An improved copier in accordance with claim 1 wherein said path length establishing means includes means for selectively adjusting the position of said bender bar for compensating for differing copy sheet twisting motions through said curved path.

3. Apparatus in accordance with claim 2 wherein said bender bar elongated edge is a curved surface extending generally transverse to the direction of copy sheet movement through said curved path.

4. Apparatus in accordance with claim 3 wherein said adjusting means includes means for selectively positioning one end of said bender bar in a direction generally transverse to the direction of copy sheet movement through said curved path.

5. In a copier having a first pair of rollers for driving copy sheets through an image transfer station and thence into a second pair of rollers for withdrawing the copy sheets from the transfer station wherein said copy sheets are directed by a curved guide so as to follow a curved path between said transfer station and said second pair of rollers and wherein the distance along the path between said roller pairs is less than the length of said copy sheets, an improvement comprising:

a bender bar having at least a portion of the surface thereof formed as an elongated curved surface; and means mounting said bender bar with said curved surface in generally facing relation to said curved guide for forming an inner guide wall for copy sheets passing through said curved path, said mounting means including means for selectively positioning one end of said bender bar along a line generally transverse to said curved path established by said curved guide.

6. Apparatus in accordance with claim 5 wherein said one end positioning means includes means selectively retaining said bender bar with the axis of said curved surface at any position within a range of angles including sloping relation toward said curved guide, away from said curved guide and parallel to a line transverse to said curved path.

7. The method for avoiding distortion of images transferred to copy sheets as they pass in proximity to a latent image carrying photoconductor surface through a transfer station of a copier which has a pair of drive rollers introducing copy sheets to the transfer station from one side and a pair of fuser rollers withdrawing copy sheets from the other side so that each copy sheet is concurrently gripped by both roller pairs for a portion of the travel thereof through the transfer station comprising the steps of:

diverting copy sheets into a curved orientation as they exit the transfer station;

engaging the inner curved surface of the diverted copy sheets to establish different path lengths for opposite edges of copy sheets as they pass from the transfer station to the fuser roller pair; and introducing the leading edge of each copy sheet into the nip of the fuser roller pair at the same angle said leading edge exits the nip of the drive rollers.

* * * * *